United States Patent [19]

Gietman, Jr.

[11] Patent Number: 4,695,005

[45] Date of Patent: Sep. 22, 1987

[54] CORELESS WINDER FOR STRIPS OF PLIABLE MATERIAL

[75] Inventor: Peter J. Gietman, Jr., Combined Locks, Wis.

[73] Assignee: Custom Machinery Design, Inc., Appleton, Wis.

[21] Appl. No.: 733,045

[22] Filed: May 13, 1985

[51] Int. Cl.[4] ..... B65H 18/10; B65H 19/26; B65H 75/24

[52] U.S. Cl. ..... 242/56 R; 83/305; 83/349; 242/74; 242/67.2; 242/72 R; 242/81; 242/76

[58] Field of Search ..... 242/56 R, 81, 72 R, 242/72.1, 74, DIG. 3, 67.2, 180, 80, 76; 83/304, 305, 349

[56] References Cited

U.S. PATENT DOCUMENTS

| | | | |
|---|---|---|---|
| 1,965,523 | 7/1934 | MacFarren | 83/305 |
| 1,977,668 | 10/1934 | Dallas | 242/81 |
| 2,449,234 | 9/1948 | Knoble | 242/56 R |
| 2,874,916 | 2/1959 | Wallin | 242/72 R |
| 3,837,596 | 9/1974 | Lagergren | 242/74 |
| 4,010,912 | 3/1977 | Dreher et al. | 242/74 X |
| 4,099,682 | 7/1978 | Benuska | 242/56 R |
| 4,159,661 | 7/1979 | Russell et al. | 83/349 X |
| 4,175,713 | 11/1979 | Jores | 242/56 R |

*Primary Examiner*—John M. Jillions

*Attorney, Agent, or Firm*—John C. Cooper, III; Fred Wiviott

[57] ABSTRACT

A winder for making coreless rolls of pliable sheet material, such as plastic, cloth or paper, includes a cut-off section for severing a continuous strip of feed material to the desired length and a conveyor system downstream thereof. A portion of the conveyor is pivotable between a first and second position to feed spaced-apart winding rod assemblies. The rod assemblies each include a pair of elongate, spaced-apart rods and a mechanism for rotating the pair of rods to wrap the feed material into a coreless roll. The rod assemblies also include a system for collapsing one of the two rods toward the other when the winding of the roll is completed and it is desired to dispense the coreless roll. A finger mechanism is also provided for properly orienting the pair of rods to receive the leading end of the pliable material. By employing multiple winding assemblies and the pivotable conveyor system, the speed of the winder can be substantially increased. The present invention is especially suitable for the winding of rolls of dropcloth or other cover-sheet materials.

12 Claims, 4 Drawing Figures

CORELESS WINDER FOR STRIPS OF PLIABLE MATERIAL

BACKGROUND OF THE INVENTION

1. Field of the Invention

The present invention relates generally to the art of winding equipment and more specifically to the art of winding strips of pliable material, such as plastic film, cloth or paper, into coreless rolls. In its preferred embodiment, the invention relates to the art of winding coreless rolls of dropcloth or other coversheet material.

2. Description of the Prior Art

A wide variety of machines are known in the art for winding strips of pliable material, such as plastic, cloth or paper, into rolls. Some machines employ cores, such as machines for winding toilet tissue, paper towels, food storage bags, etc. Other machines are known which can produce coreless rolls. For example, the present inventor has previously developed a coreless winder for producing coreless rolls of plastic bags, such as trash or garbage bags, kitchen trash can liners, etc. Such prior art coreless winders are not, however, suitable for the production of coreless rolls of wide materials, such as dropcloths, plastic coversheets, large paper rolls, rolls of decorative material, tablecloths, package wrapping, etc. Such materials have conventionally been prepared in rolls which contain cores.

While the present invention has a wide variety of uses, the prior art will be further illustrated by reference to the winding of plastic dropcloth or coversheet material. Such materials are typically prepared from a plastic, such as polyethylene, which is melted in a bubble extruder to produce a continuous tube, the circumference of which can be twelve feet or more. The tube is slit along its length to produce a continuous lay-flat strip of plastic having a width equivalent to the circumference of the bubble. The thickness of the film can vary widely, e.g., from 0.4 mil up to about 4 mils. As the film leaves the slitting station, it can be reduced in width longitudinally by folding or gussetting.

Downstream processing of the plastic film is accomplished in many different ways in the prior art, but to the knowledge of the present inventor, the prior art has not disclosed any techniques for rapidly winding such material into coreless rolls, such as rolls having finished roll diameters of 6½ inches or more. Such a system would represent a significant advance in the art.

OBJECTS AND SUMMARY OF THE INVENTION

It is a principal object of the present invention to provide a fast and efficient winder for elongate strips of pliable material, such as paper, cloth or plastic.

Another object of the present invention is to provide a winder having two or more winding positions, whereby winding speed can be increased.

Yet another object of the invention is to provide winding assemblies which allow for the easy removal of coreless rolls.

A different object of the present invention is to provide a cut-off section for the pliable material which permits accurate severing of the feed material at any desired length.

A still further object of the present invention is to provide conveyor systems for such a winder which allow the pliable material to be directed to different winding assemblies.

Another object of the invention is to provide a winding assembly alignment device to assure accurate feeding of the leading edge of the pliable material into the winding assembly.

How these and other objects of the invention are accomplished will be described in the following description of the preferred embodiment, taken in conjunction with the drawings. Generally, however, the objects are accomplished in a winding apparatus which includes a dancer system for "slaving" the winder to the sheet material feed device (e.g., an unwind station or a film extruder). The sheet material enters a pull roll section, having a specified roll diameter, which cooperates with a stationary knife bed and a rotating fly knife to permit accurate separation of the feed material into strips having the desired length. A first conveyor section follows the cut-off section and leads to a pivoting conveyor section, the latter being adapted to selectively direct the sheet material to one of a plurality of winding assemblies. Each winding assembly features dual rods, the rods being spaced apart to receive the leading edge of the sheet material to be wound. The rods are aligned in a specific position prior to receipt of the leading edge. The winding assemblies also include systems for causing rotation of the rods to effect the winding of the sheet material. As winding is accomplished on a first winding assembly, the pivotable conveyor is moved to a different location adjacent a different winding assembly. When the sheet material from the first roll exits the pivotable conveyor on its way to the first winding assembly, the system then is already positioned for feeding the next strip to the second winding assembly. Each winding assembly includes a mechanism for collapsing one of the two rods toward the other, whereby the inner wraps of the sheet material are loosened to permit easy removal of the roll. A push-off palm may be employed to assist in roll removal. Other ways in which the objects are accomplished will be described or will become apparent in the remainder of the specification, all of which are deemed to fall within the scope of the present invention.

DESCRIPTION OF THE DRAWINGS

Like reference numerals are employed in the various drawings to illustrate like components.

DETAILED DESCRIPTION OF THE PREFERRED EMBODIMENT

Before proceeding to the detailed description of the preferred embodiment, several general observations concerning the present invention are in order. First, while the illustrated embodiment shows a pair of winding assemblies and a pivoting conveyor section adapted to move between two positions, further winding stations and conveyor positions could be employed without departing from the scope hereof. Further, the roll widths and finished roll diameters can vary widely, and one skilled in the art would be readily able to select dimensions after this description of the preferred embodiment has been read and understood. Also, as previously mentioned, while the present invention will be described as a dropcloth winder, paper, cloth or other pliable materials can be wound using the winder of the present invention.

Figure 1:
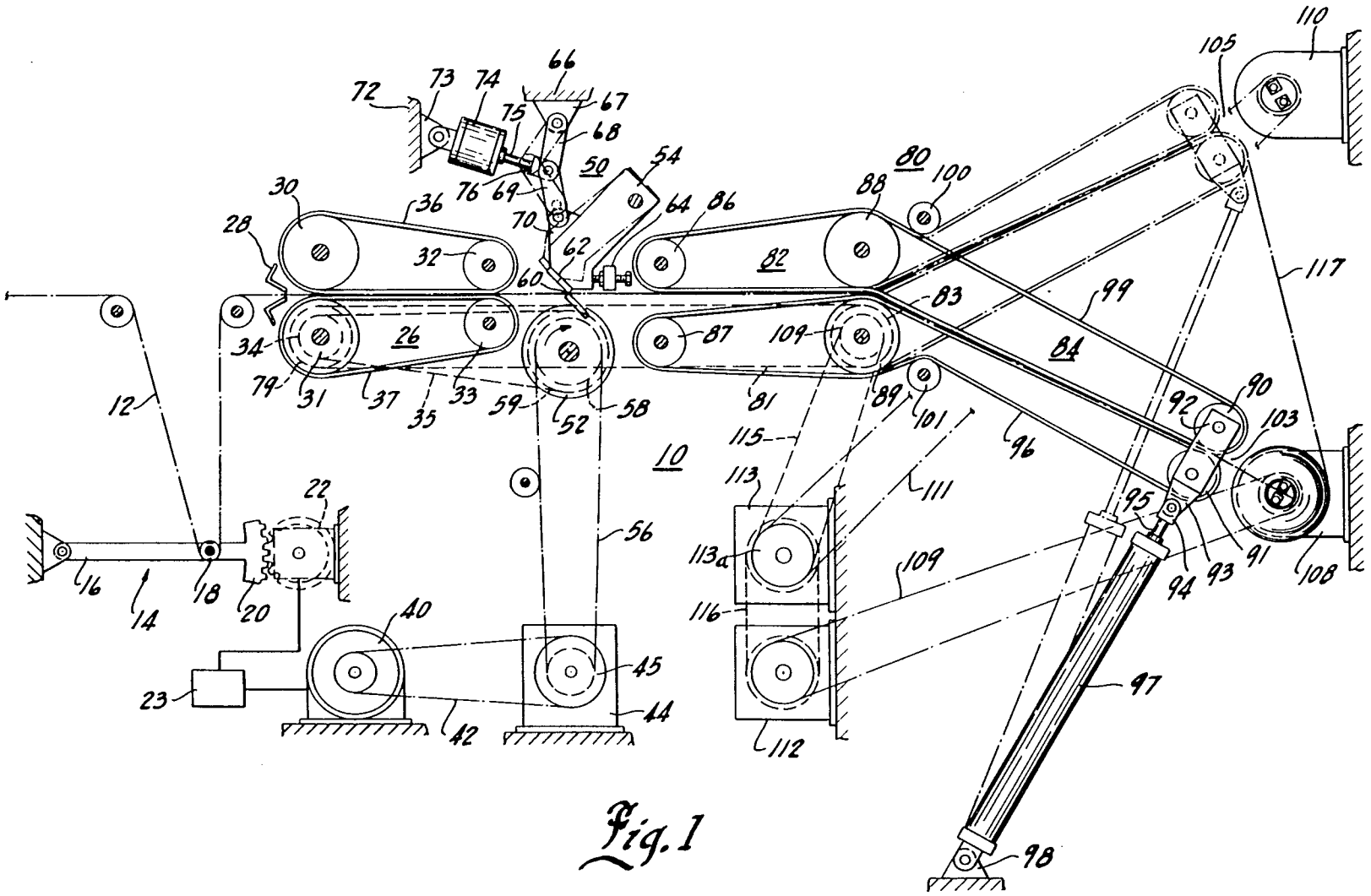
FIG. 1 is a side elevation schematic view of a winder according to the preferred embodiment of the present invention.

The general principles of the invention can best be understood by explaining the winder 10 shown in FIG. 1. A feed strip 12 of dropcloth material enters the machine from an upstream supply (such as an unwind station or extruder). Strip 12 is typically folded longitudinally, depending on the width of the desired final roll, by folding boards (not shown) which themselves are well known to the art. For purposes of the description of FIG. 1, it will be assumed that strip 12 has a folded width of 12–18 inches, a typical size for consumer oriented products.

The strip 12 enters a dancer mechanism 14 which is shown only schematically. Dancers themselves are old, and any known dancer can be employed in the present invention. The function of dancer 14 is to "slave" the speed of winder 10 to the speed of the film supply system. Such slaving is accomplished by employing a pivotable member 16 having one or more rolls 18 thereon. The film strip 12 passes around roll 18 and the tension of the strip (and accordingly the speed differential between feeder and winder) will cause movement of the pivot element 16. The free end 20 of element 16 is coupled to a sensing device 22, such as a potentiometer. Device 22 senses the position of element 16 and continuously adjusts the speed of winder 10, through control box 23, as will be more fully described hereafter.

After passing through dancer mechanism 14 the film strip 12 enters a pull roll and feed section 26, the entrance to which is protected by guards 28 for operator safety. Pull roll section 26 includes four generally cylindrical rollers, a pair of larger pull rollers 30 and 31 disposed above one another at the entrance and a pair of smaller rollers 32 and 33 at the exit end. The pairs of rollers form nips. Upper rollers 30 and 32 are joined together by a plurality of spaced-apart ropes 36 which are located in annular grooves across the width of upper rollers 30 and 32. The bottom rollers 31 and 33 are connected by an endless belt 37. The film 12 then is conveyed through the nips and between the ropes and belt as it passes through pull roll and feed section 26.

Ropes 36 are preferably elastic nylon ropes, but other types of ropes could be employed in this section, as well as in the downstream sections where similar ropes are employed. In lieu of such ropes, spaced-apart endless strips could be employed or a single continuous belt could be substituted for the plurality of ropes used in the preferred embodiment. The pull roll and feed section 26 is driven through a pulley 34 attached to roller 31 and a drive belt 35.

Winder 10 includes a drive motor 40 coupled by a drive belt 42 to a gear reducer 44. Motor 40 is coupled by known means to the control box 23 so that the speed of motor 40 will be slaved appropriately as described above. The gear reducer 44 in turn includes a pulley 45 thereon.

In the preferred embodiment, the pull rolls 30 and 31 have a circumference of twelve inches so that for every revolution thereof, one foot of material is passed through pull roll and feed section 26. While the diameter of these rolls is not critical to the present invention, the use of rolls having a circumference equal to a convenient measurement, such as one foot or one meter, makes possible a more precise cut-off of exact lengths of material for the final roll product.

After the film passes through the pull roll and feed section 26 it enters a cut-off section 50 which includes a rotating fly knife 52 and a bed knife 54. The fly knife 52 includes a first pulley 58 which is coupled to gear reducer pulley 45 by a drive belt 56 and a second pulley 59 coupled to pulley 34 of roll 31 by belt 35. Rotating fly knife 52 includes a knife 60 embedded in its surface.

In the present invention, bed knife 54 is pivotably mounted for movement between the full line position of FIG. 1 and the dotted line position shown therein. In the dotted line position, it will be apparent that the film can pass through cutting section 50. However, when in the full line position, a knife 62 on the bed knife is forced against the knife 60 to effect a scissor-like separation of the strip 12. Knife 62 is restrained by an adjustable stop 64.

Movement of the bed knife 54 is accomplished using a collapsible link system coupling the knife 54 to two separate locations on the winder frame. A first such location 66 includes a bracket plate 67 having a first elongate link 68 pivotably coupled thereto. A second elongate link 69 is pivotably coupled to the free end of the first link 68 and a bracket 70 on bed knife 54. At the second location 72 on the frame a bracket 73 is pivotably coupled to the butt end of a pneumatic cylinder 74 which has a piston rod 75 extending therefrom. A clevis 76 at the end of rod 75 is rotatably coupled to the union of links 68 and 69. The lengths of links 68 and 69 are selected so that when they are arranged linearly, the distance between brackets 67 and 70 will be equal to that distance required to locate bed knife 54 in its cutting (full line) position. On the other hand, when the links 68 and 69 are angled with respect to one another, the bed knife will be spaced apart from the fly knife (i.e., the dotted line position).

In operation then, cylinder 74 normally will have its rod 75 retracted. Upon a signal, however, the pneumatic cylinder will receive compressed air from an air source (not shown), causing rod 75 to extend. In turn, the links will be caused to align themselves longitudinally to move bed knife 54 against stop member 64. At this point, strip 12 is scissored and a separated strip of plastic, having a precisely determined length, is created. While any type of signal imput device could be used for sequencing the operation of cylinder 74, in the preferred embodiment of the invention this is accomplished by a system (not shown) which receives a pulse signal with each revolution of the pull rollers 30, thus indicating the number of feet of film passing through the nip between knives 52 and 54. A counter (not shown) coupled to the sensor counts the impulses from the sensor and a "footage" counter can be programmed by the machine operator for any length of material. As the count reaches the preselected level, cylinder 74 is activated to initiate the cut-off. As will become apparent shortly, the signal indicating the passage of a preselected length of material is also used to initiate other operations of winder 12.

Following strip cut-off, a new leading edge of the folded plastic strip is created. That edge enters a conveyor system 80 having a first stationary portion 82 and a second movable portion 84. The stationary portion is comprised of a pair of inlet rollers 86 and 87 near the exit of the cut-off section 50 and a pair of larger rollers 88 and 89 downstream of rollers 86 and 87. A belt 81 drives the roller 89 through a pulley 83 affixed thereto. Belt 81 is also coupled to another pulley 79 on roller 31. From FIG. 1, it can be seen that rollers 86 and 87 are spaced apart from one another to provide a space to receive the leading edge of the new strip of film, while the rollers 88 and 89 are located above one another to provide a nip.

Located downstream of rollers 88 and 89 are another pair of smaller rollers 90 and 91 which are rotatably mounted between a pair of parallel rectangular plates 92. Plates 92 have a connecting member 93 located below the lower roller 91 which member includes a hole. That hole is coupled in turn to a clevis 94 secured to the external end of a piston rod 95 of another pneumatic cylinder 97. The opposite end of cylinder 97 is pivotably coupled to the winder frame at bracket 98.

Nylon elastic ropes 99 are provided for the top set of rollers 86, 88 and 90, such ropes being generally similar to the ropes used in the pull roll and feed section 26. As previously suggested, belts or straps could be substituted therefor. A continuous belt 96 connects the lower rollers 87, 89 and 91. Furthermore, rope and belt tensioning rollers 100 and 101 are provided to insure that slippage does not occur in conveyor system 80 and to correct for any stretching of the ropes 99 or belt 96 which may take place.

From the description of system 80, it will be appreciated that extension of piston rod 95 will cause the outlet of the movable conveyor section 84 to be raised from a first lower location 103 to an upper location 105, while at the same time the conveyor system 80 remains fully operational and while sheet material 12 is being conveyed therethrough. It should also be appreciated that sequencing of cylinder 97 is ultimately derived from the same sensor which activates cylinder 74.

The final components of winder 10 to be described in connection with FIG. 1 are a pair of winding assemblies 108 and 110 located respectively adjacent the outlets 103 and 105 of conveyor system 80. These winding assemblies will be described in greater detail hereafter, but it should be indicated that they are driven by belts 109 and 111, respectively, from a pair of magnetic particle clutches 112 and 113, which in turn are driven by a belt 115 coupled to a pulley 110 on clutch 113 and a pulley 109 on roller 89. Clutch 112 is driven by a belt 116 from clutch 113. Each of clutches 112 and 113 has a high and low torque circuit, the purpose of which will become apparent hereafter.

The operation of winder 10 can now be explained. When a first strip of material is fed through conveyor system 80, it will be directed to outlet 103 for winding on winding assembly 108. How that is accomplished will be described later. Winding will progress until the footage sensor determines that the preselected length of material has passed through the cut-off section 50. At that time, the two cylinders 74 and 97 will be activated to sever the film strip 12 and move the movable portion 84 of conveyor system 80. At the time the cut is made, film will still be winding on winding assembly 108 and such winding will continue, even though the conveyor outlet has been moved to the position indicated by reference numeral 105. That feature of the invention is illustrated by the film strip line 117 in FIG. 1. It should also be apparent that as the tail of the first strip is being wound on winding assembly 108, the conveyor system 84 is positioned so that the leading edge of the next strip can be immediately introduced into winding assembly 110. The entire process would be reversed after the next severing step so that the third strip will be ready for attachment to winding assembly 108, as the winding of the second strip is finished on assembly 110, etc.

Figure 2:
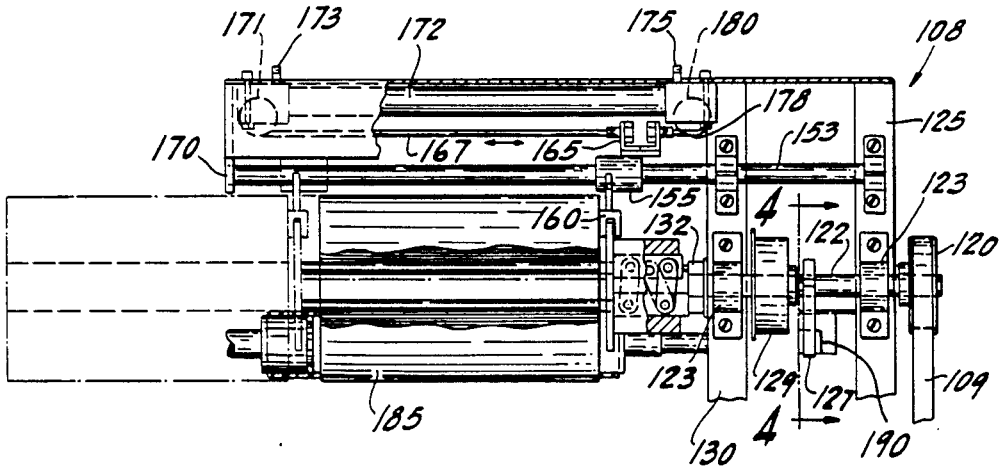
FIG. 2 is a detailed front view of a dual rod winder according to the preferred embodiment of the invention.

Referring next to FIG. 2, the construction and operation of the winding assemblies can be explained in greater detail. This FIGURE illustrates the winding assembly 108 having a full roll of plastic wound thereon and shows both the initial winding position (full line) and the roller removal position (dotted line).

Drive belt 109 is coupled to a main drive shaft 122, supported in a bearings 123 affixed to winder frame 125. Inside the frame 125, an elongate finger element 127 is rigidly secured to shaft 122 and extends radially in one direction therefrom. Internally of finger element 127 is a brake 129 adapted to stop the rotation of winding assembly 108 after completion of a roll.

Figure 3:
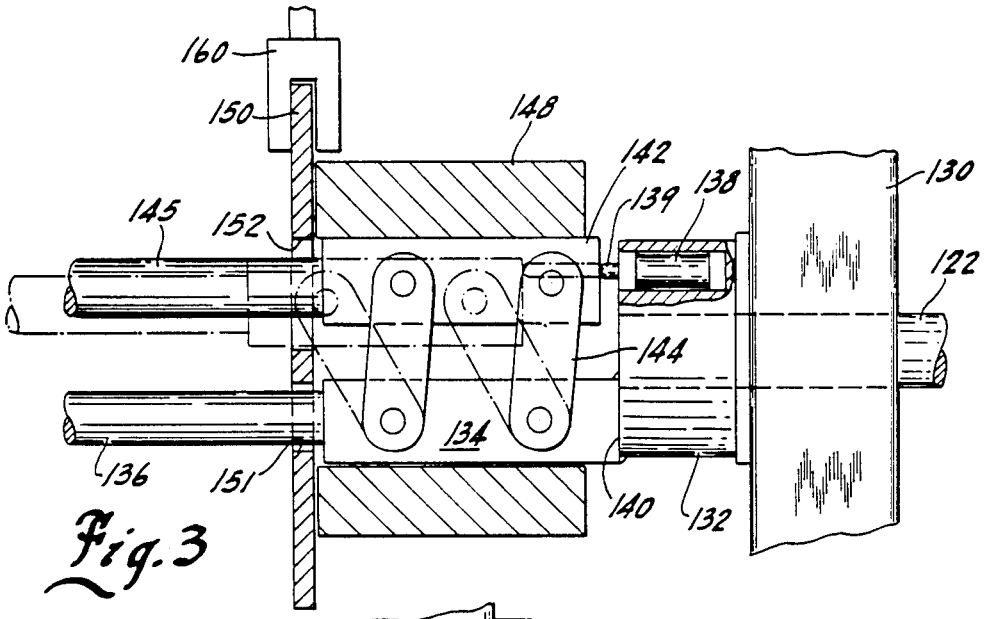
FIG. 3 is a detailed view of the dual rod collapsing mechanism of the winder of the preferred embodiment of the present invention.

A further frame element 130, parallel to frame element 125, is located inside of brake 129 and the drive shaft 122 passes through this frame element as well. On the interior of frame element 130 a cylindrical housing 132 is affixed to the internal end of drive shaft 122. A connector element 134 is rigidly secured to one side of housing 132, and the first rod 136 of a pair of winding rods is secured to the opposite end of connector element 134. At the other side of housing 132 a cylinder 138 is provided having a piston rod 139 extending there-from (FIG. 3). Cylinder 138 and rod 139 are construed so that the tip of rod 139 is just inside of the inner surface 140 of housing 132 when the rod is retracted and so that it will extend inwardly therefrom when it is extended.

A second connector segment 142 is mounted above and spaced apart from segment 134 by two pairs of links 144 pivotably coupled to segments 134 and 142. The links are arranged on the front and back surfaces of the segments with the pairs of links on each side being parallel and spaced apart from one another. They are further arranged so that when segment 142 is located adjacent the inner face 140 of housing 132, the parallel links 144 are inclined slightly toward the tip of piston rod 139.

The second winding rod 145 is secured to the inner end of segment 142. Now, by examining FIG. 3, it can be seen that movement of rod 139 to its dotted line position will cause the links 144 to rotate to the left and at the same time will cause the second winding rod 145 to move slightly toward the lower fixed rod 136. In practice, the rods may be about three-fourth inch apart when in the winding or full line position, and the space therebetween is decreased significantly (for example, by at least one-fourth inch or more) when the cylinder 138 is activated. A cylindrical can 148 surrounds segments 134 and segment 142 during collapsing of the rod.

Winding assemblies 108 and 110 also each include a system for removing rolls from the rods 136 and 145. In the illustrated embodiment, this is accomplished by providing a push-off plate member 150 on its inner end. The plate 150 has a lower hole 151 and a top slot 152 through which rods 136 and 145 extend.

A second shaft 153 is mounted in frame elements 125 and 130, shaft 153 being parallel to and spaced apart from shaft 122. The distance of separation should be greater than the largest diameter roll to be made on winder 10. A cylindrical slide member 155 is provided around shaft 153 which is movable on shaft 153 from an initial position, where it is located approximately opposite plate 150 (as shown in FIG. 2) to a second position which would be located at the vicinity of the ends of the rods 136 and 145. A yoke member 160 is attached to slide 155. It straddles the top of plate 150.

While any suitable drive may be employed for moving slide 155 from its first to its second position, in the illustrated embodiment this is accomplished by attaching a U-shaped bracket 165 to the side of slide 155 opposite to that from which yoke member 160 extends. A cable 167 is attached to one side of bracket 165 and extends generally parallel to shaft 153 toward an inner frame element 170. At the rear of the frame, a pulley 171 is mounted at one end of another air cylinder 172 having an air inlet 173 and an air outlet 175. The cable 167 passes around the pulley 171 and enters cylinder 172 and is attached to the piston thereof. A second cable 178 is attached to the opposite side of bracket 165 and extends toward frame element 130. Inside frame element 130 is another pulley 180, around which cable 178 passes and enters cylinder 172. Cable 178 is attached to the opposite side of the piston (not shown) of cylinder 172.

From the foregoing description, those skilled in the art will now understand that film is introduced into the gap between rods 136 and 145 when the rods are separated from one another the maximum distance designed into the system. The links are oriented slightly off vertical and toward cylinder 138 so that the rods are in effect "cocked" over center in an open position. After several inches of the film strip is passed through the opening between the rods (four to five inches in the preferred embodiment), the magnetic particle clutch coupled to the particular winder will engage in its high torque mode to begin the winding process. After the desired amount of material has been wound on rods 136 and 145 (keeping in mind that the conveyor system 84 has shifted before this time), a timing sequencer (not shown) stops the rotation of shaft 122 by means of air brake 129. At this point, the roll of material 185 must be removed. This is accomplished by a two-step process. First cylinder 138 is activated to move the two rods together and loosen the inner wraps of the film. After such collapsing of the rods, the cable air cylinder 172 is activated to cause the push-off plate 150 to push the roll off the rods 136 and 145. Actually, cylinders 138 and 172 may be activated at the same time so that cylinder 138 need only initiate the collapsing of the rods. Once such initiation starts the rotation of links 144 past a vertical position, the plate 150 itself will complete the collapsing of the two rods.

After the cable air cylinder 172 has moved the push-off plate a distance sufficient to remove the roll, a trigger (not shown) within the cylinder contacts a magnetic reed switch in cylinder 172 and a solenoid is activated to return the push-off plate to its initial position. As it does so, it pushes the collapsing rod backwards and "cocks" the rod in the opened position, thus preparing the system for the next winding sequence. The dispensed roll can be packaged in any suitable manner and the downstream handling of the roll forms no part of the present invention.

Figure 4:
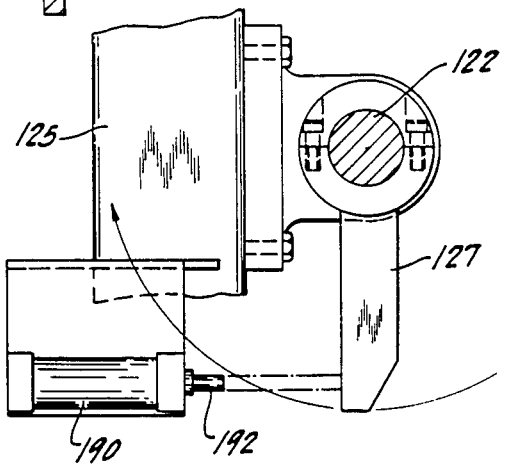
FIG. 4 is a view taken along the line 4—4 of FIG. 2 and illustrating in greater detail the finger mechanism for aligning the spaced-apart rods.

When the winding assembly 108 or 110 is stopped by brake 129 to unload the finished roll, it could be oriented in any position, and it is another feature of the present invention to provide a system for properly orienting the rods so that the leading edge of the next film strip can be properly introduced therebetween. That system involves the finger element 127 previously described. It also involves another cylinder, a positioning cylinder 190 having an extensible rod 192 (see FIG. 4). When the push-off plate 150 is returned to its initial position, a switch is triggered causing extension of rod 192 into the normal arc of rotation of finger element 127. Rotation of the shaft will be stopped in a predetermined location. The low torque setting on the magnetic particle clutch advances the winding assembly and keeps the finger against the extended positioning cylinder rod until winding is again desired. At that point, rod 192 is retracted and the magnetic particle clutch is switched to the high torque setting.

While the electronics of the above system have not been described in detail, a programmable controller has been used by the present inventor to start and stop all the sequencing operations involved in the present invention. One skilled in the art, after reading the foregoing description, could readily conceive and design a number of electrical systems for the present invention. Moreover, a number of changes could be made to the present invention, beyond those previously suggested, without departing from the invention,s scope. For example hydraulic cylinders could be employed in place of the pneumatic cylinders. Other drive systems (other than the A-C motor and clutches pictured) could also be used. Thus, while only a single preferred embodiment has been shown, the present invention is not to be limited solely by that description but is to be limited solely by the claims which follow.

I claim:

1. A winder for winding elongate strips of pliable material, such as plastic film, cloth or paper, into coreless rolls, said winder including:

cut-off means for forming strips of pliable material of a preselected length;

conveyor means for conveying said strips of pliable material from said cut-off means;

at least two winding assembly means for winding said strips of pliable material into coreless rolls;

said conveyor means consisting of a first extended stationary portion, immediately adjacent said cut-off means and having top and bottom conveying surfaces forming a nip for accepting a leading edge of said strip of pliable material from said cut-off means, and a second movable portion for alternately directing said stips of pliable material to different ones of said winding assembly means;

means for driving said conveyor means;

means for driving said winding assemblies wherein said movable portion of said conveyor means comprises an outlet formed by the ends of said top and bottom conveying surfaces, said winder including a first cylinder means having an extensible piston rod means, said rod means being coupled to said conveyor outlet for moving said outlet from a first position in which said outlet is disposed adjacent a first one of said winding assemblies to at least another position in which said outlet is located adjacent another of said winding assemblies wherein said stationary portion and said movable portion of said conveyor means comprise a plurality of pairs of roller means spaced between said cut-off means and said outlet, said pairs of roller means including a top roller and a bottom roller, single endless means surrounding the top rollers to provide a top conveyor surface and single endless means surrounding the bottom rollers to provide a bottom conveyor surface, whereby pliable material passing into said nip and between said conveyor surfaces is conveyed through said conveyor means.

2. The invention set forth in claim 1 wherein said surrounding means comprise a plurality of ropes spaced apart across the width of said top rollers.

3. The invention set forth in claim 1 wherein said cut-off section comprises a rotating fly knife and a bed knife and means for driving said rotating fly knife.

4. The invention set forth in claim 3 wherein said bed knife is movable between a first position in which said bed knife is spaced apart from said rotating fly knife to allow said pliable material to pass through said cut-off section.

5. The invention set forth in claim 4 wherein said winder includes a frame and said bed knife is coupled to said frame by a pair of elongate link means, said link means being pivotably coupled to one another, cylinder means coupled to said frame and having a piston rod extensible therefrom, the free end of said piston rod being coupled to said coupling of said link means, whereby when said piston rod is extended said link means are generally co-linear and when said piston rod is retracted said link means are non-linear with respect to one another, said bed knife being in said first position when said piston rod is extended and in said second position when said piston rod is retracted.

6. The invention set forth in claim 5 further comprising stop means for said bed knife.

7. The invention set forth in claim 1 wherein each of said winding assemblies includes a pair of generally parallel and spaced-apart elongate rod means, means for simultaneously and periodically reducing the space between said pair of rod means and removing rolls of pliable material from the pair of rod means as said space therebetween is reduced, and wherein said means for driving said winding assemblies comprises means for rotating said pair of rod means to wind said pliable material around said pair of rod means.

8. A winder for winding elongate strips of pliable material, such as plastic film, cloth or paper, into coreless rolls, said winder including:

cut-off means for forming strips of pliable material of a preselected length;

conveyor means for conveying said strips of pliable material from said cut-off means;

at least two winding assembly means for winding said strips of pliable material into coreless rolls;

said conveyor means including a movable portion for alternately directing said strips of pliable material to different ones of said winding assembly means;

means for driving said conveyor system;

means for driving said winding assemblies;

wherein each of said winding assemblies includes:

a pair of generally parallel and spaced-apart elongate rod means, and wherein said means for driving said winding assemblies comprises means for rotating said pair of rod means to wind said pliable material around said pair of rod means; and means for periodically reducing the space between said pair of rod means and means for removing rolls of pliable material from the pair of rod means when said space therebetween has been reduced; and wherein said space reducing means comprises a first one of said rod means which is rigidly secured to a rotatable support means of said winding assembly, the second one of said rod means coupled to an axially movable component of said rotatable support means, cylinder means on said winding assembly having a piston rod extensible therefrom and retractable therein, link means coupling said support means and said movable component, said piston rod being adjacent said movable component whereby extension of said piston rod from said cylinder means causes said space between said rod means to be reduced.

9. The invention set forth in claim 8 wherein said roll removal means comprises plate means having a hole and a slot therein, said plate means being perpendicular to the axis of rotation of and surrounding said rod means, and plate drive means for moving said plate from a first position to a second position to slide a roll of pliable material from said rod means.

10. The invention set forth in claim 9 wherein said plate means in its first position is located adjacent said movable component whereby movement of said plate means from said second position to said first position increases the space between said pair of rod means.

11. The invention set forth in claim 8, wherein each of said winding assemblies includes a shaft means for rotating said pair of rod means and means for aligning said pair of rod means to allow the introduction of said pliable material therebetween.

12. A winder for winding elongate strips of pliable material, such as plastic film, cloth or paper, into coreless rolls, said winder including:

cut-off means for forming strips of pliable material of a preselected length;

conveyor means for conveying said strips of pliable material from said cut-off means;

at least two winding assembly means for winding said strips of pliable material into coreless rolls;

said conveyor means including a movable portion for alternately directing said strips of pliable material to different ones of said winding assembly means;

means for driving said conveyor system;

means for driving said winding assemblies;

wherein each of said winding assemblies includes:

a pair of generally parallel and spaced-apart elongate rod means, and wherein said means for driving said winding assemblies comprises means for rotating said pair of rod means to wind said pliable material around said pair of rod means; and shaft means for rotating said pair of rod means and means for aligning said pair of rod means to allow the introduction of said pliable material therebetween wherein said alignment means comprises an elongate finger element extending radially from said shaft means and a cylinder means having a piston rod means, said piston rod means being arranged to contact said finger element when said finger element is in a preselected position, said preselected position being that position of rotation of the shaft wherein said pair of rod means is aligned to receive said pliable material.

* * * * *